US005739832A

United States Patent [19]

Heinzl et al.

[11] Patent Number: 5,739,832

[45] Date of Patent: Apr. 14, 1998

[54] DROPLET GENERATOR FOR GENERATING MICRO-DROPS, SPECIFICALLY FOR AN INK-JET PRINTER

[75] Inventors: Joachim Heinzl, Munich; Wolfgang Schullerus, Bad Feilnbach, both of Germany

[73] Assignee: Pelikan Produktions AG, Egg Zh, Switzerland

[21] Appl. No.: 562,004

[22] Filed: Nov. 22, 1995

[30] Foreign Application Priority Data

Nov. 24, 1994 [CH] Switzerland ..... 3545/94

[51] Int. Cl.[6] ..... B41J 2/045

[52] U.S. Cl. ..... 347/68; 347/71

[58] Field of Search ..... 347/40, 48, 68, 347/70, 71

[56] References Cited

U.S. PATENT DOCUMENTS

| | | | |
|---|---|---|---|
| 4,564,851 | 1/1986 | Nilsson et al. | 347/68 |
| 5,373,314 | 12/1994 | Everett et al. | 347/71 |
| 5,477,253 | 12/1995 | Hotomi et al. | 347/71 |

FOREIGN PATENT DOCUMENTS

| | | |
|---|---|---|
| 0398031 A1 | 10/1982 | European Pat. Off. . |
| 0062889 A1 | 11/1990 | European Pat. Off. . |
| 0516188 A1 | 12/1992 | European Pat. Off. . |
| 3114192A1 | 10/1982 | Germany . |
| 3114224A1 | 11/1982 | Germany . |
| 3114259A1 | 11/1982 | Germany . |
| 4-185444 | 7/1992 | Japan . |

*Primary Examiner*—Stuart N. Hecker

*Attorney, Agent, or Firm*—Fay, Sharpe, Beall, Fagan, Minnich & McKee

[57] ABSTRACT

A droplet generator includes a housing (1) wherein there are attached at their one end a multitude of piezo-electric flectional-benders (19), arranged next to each other. A second end (16) of each of the benders (19) is located above a separate jet (7) which leads from a chamber (5) to the exterior. Between the individual benders (19) there are installed separation walls (26). Any cross communication as a result of viscous coupling between benders or due to pressure fluctuations is avoided and the efficiency is improved, so that a better graphic image is attained. The benders have an electrically insulating coating, so that the droplet generator is also suitable for electrically conducting inks.

12 Claims, 3 Drawing Sheets

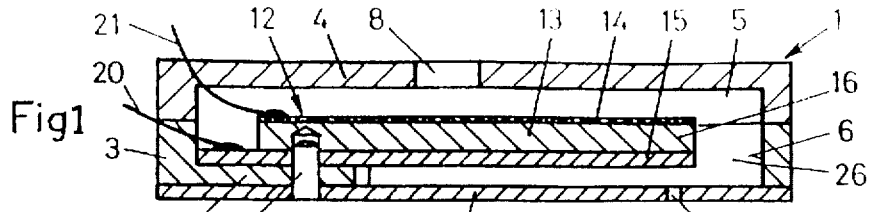
Fig1
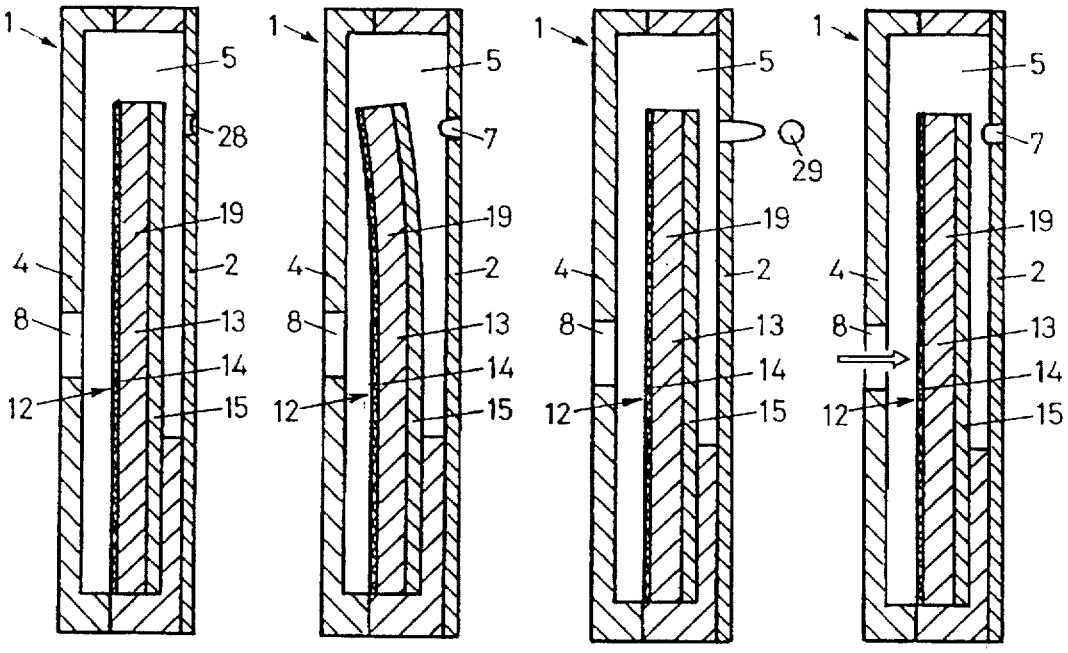
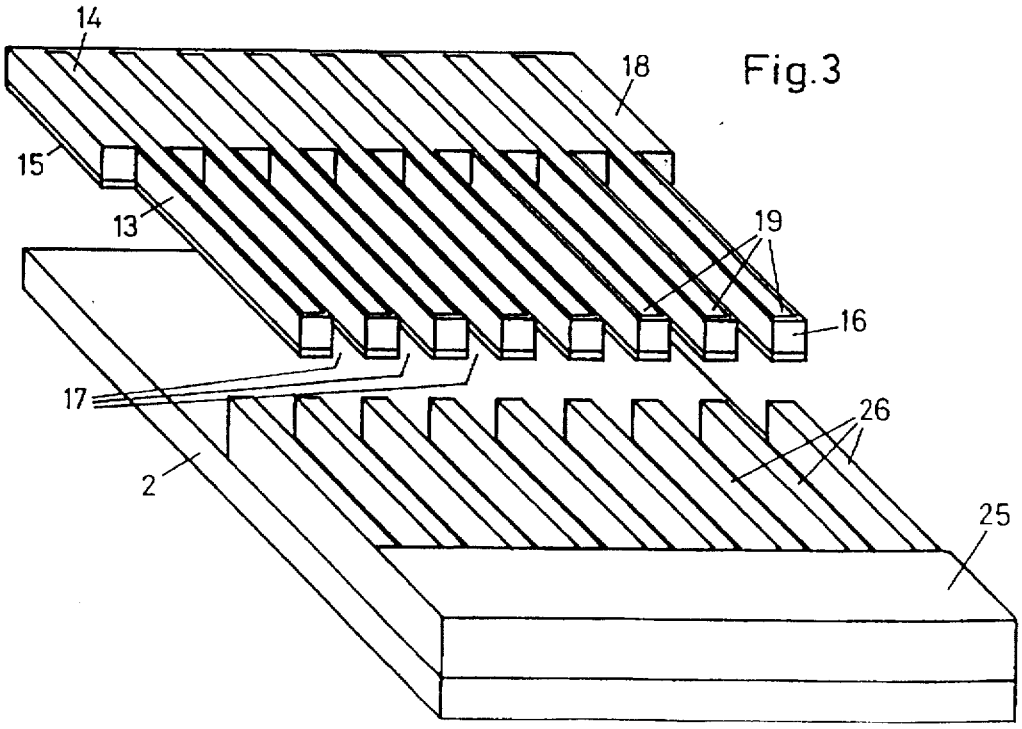
Fig.3

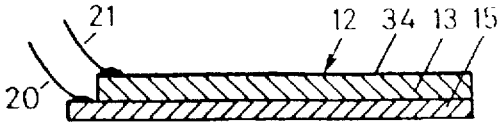
Fig. 6
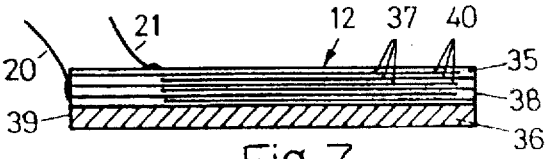
Fig. 7
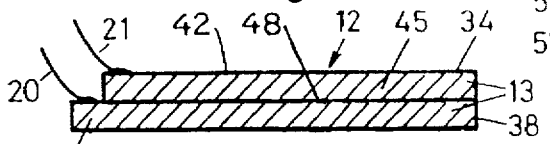
Fig. 8
Fig. 9
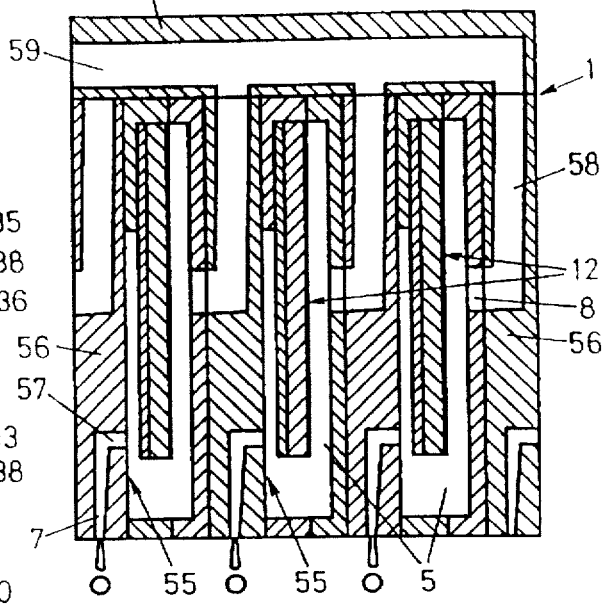
Fig. 10
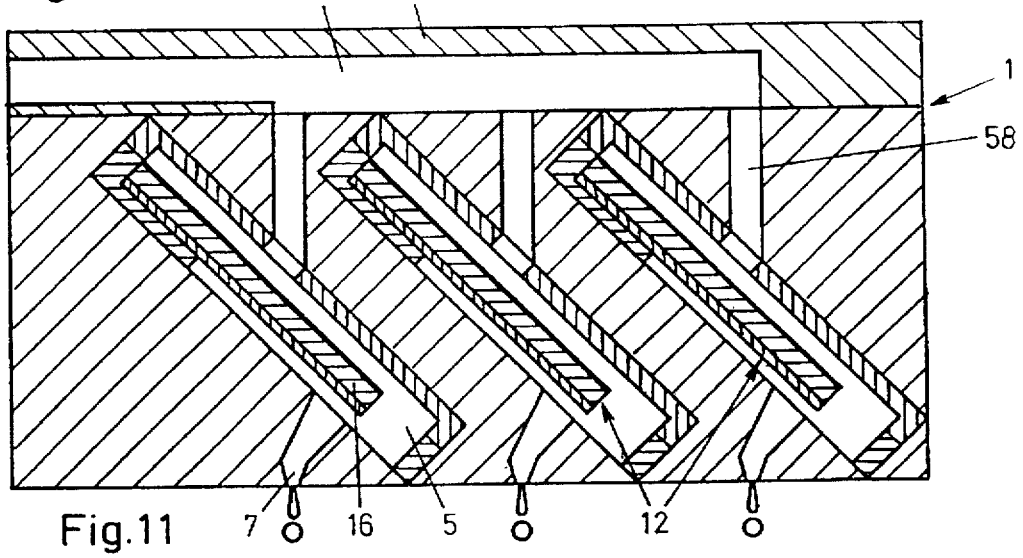
Fig. 11
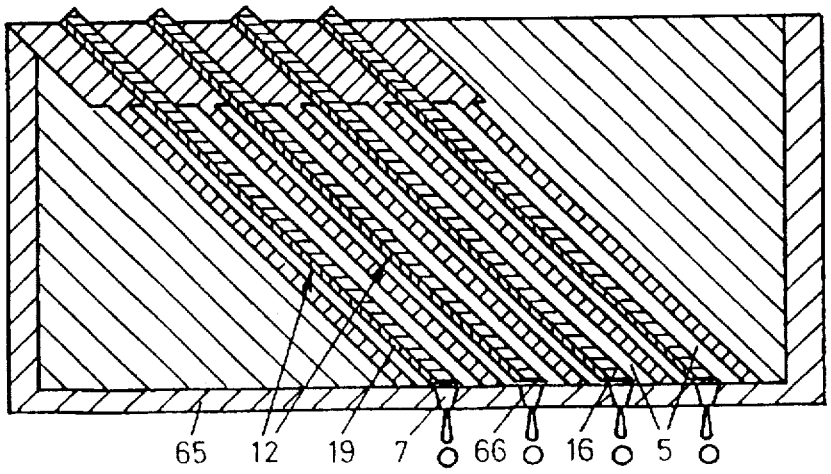

DROPLET GENERATOR FOR GENERATING MICRO-DROPS, SPECIFICALLY FOR AN INK-JET PRINTER

BACKGROUND OF THE INVENTION

A droplet generator for generating micro-droplets is known from the German Patent Disclosure Document 31 14 192. In an ink-filled chamber of a housing, there are arranged a multitude of piezo-electric flectional benders. Each bender is respectively assigned to a jet passing through a housing wall. If one of the benders is activated, a droplet of ink is expelled from the respective jet. The droplet generator is of simple construction. The printed picture, however, is not satisfactory, sometimes uneven and blurred. Similar droplet generators are described in the German Patent Disclosure Documents DE-OS 31 14 224 and DE-OS 31 14 259.

The present invention has for its objective the correction of the above drawback. This objective is achieved by combining the characteristics of the claims.

SUMMARY OF THE INVENTION

By the use of separation walls between the individual flectional benders, any cross-communication between the adjoining benders is totally avoided. That is, the separation walls act to reliably prevent the activation of one bender from causing ink to simultaneously exit from an adjacent jet. This is so since the pressure waves produced by activation of one bender can no longer expand to an adjacent jet. Moreover, viscous coupling between adjacent benders is totally avoided. Inasmuch as the ink under the activated flectional bender can no longer yield laterally, a significantly higher pressure is generated at the jet, with identical excursion of the bender. Therefore, on the one hand, a significantly higher and more constant drop traveling velocity can be achieved, and, on the other hand, lower power is required.

BRIEF DESCRIPTION OF THE DRAWINGS

Below, exemplary embodiments of the invention are explained with the help of the drawings wherein:

FIG. 1 shows a longitudinal section through a droplet generator formed in accordance with the invention;

FIGS. 2*a* to 2*d* show the droplet generator according to FIG. 1 in different operating conditions;

FIG. 3 shows a perspective view of a part of the droplet generator;

FIGS. 6–8 show cross-sections through three alternate embodiments of the bender; and, FIGS. 9–11 show cross-sections through three embodiments of multi-layer droplet generators.

DETAILED DESCRIPTION OF THE PREFERRED AND ALTERNATE EMBODIMENTS

Figure 4:
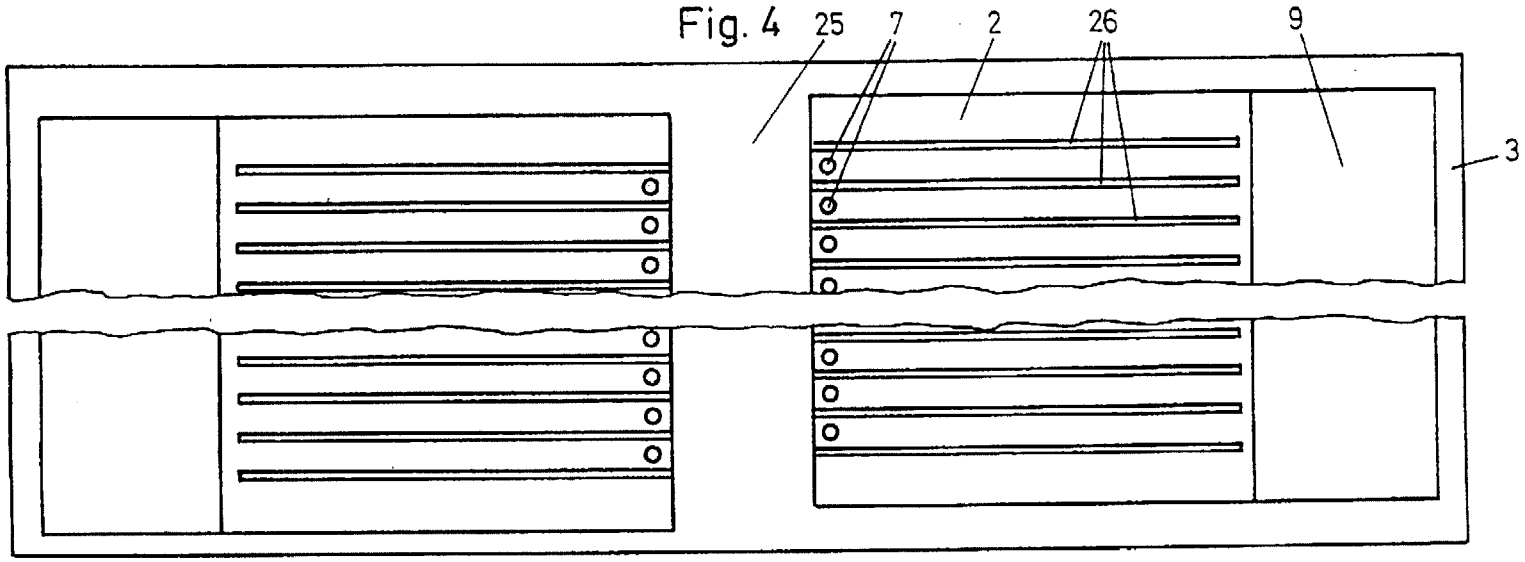
FIG. 4 shows a top plan view of a jet plate with separation walls and frame.
Figure 5:
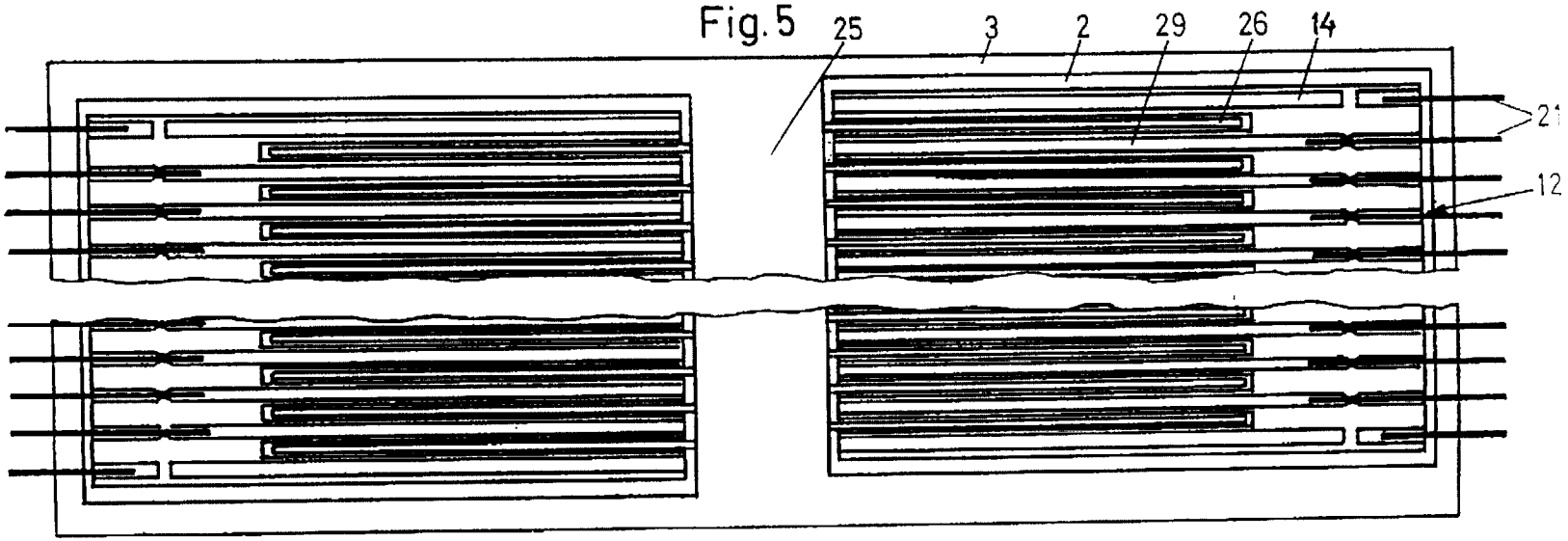
FIG. 5 shows a top plan view according to FIG. 4 with inserted bender units.

The droplet generator according to FIGS. 1–5 has a housing 1 comprising a jet plate 2, a frame 3 and a cover plate 4, which jointly form an enclosed chamber 5. The jet plate 2, has adjacent to a wall 6 of frame 3, a rectilinear series of regularly spaced jets 7. The cover plate 4 has an inlet aperture 8, opening into chamber 5, for connection of an ink storage container, which is not shown. At a support 9, attached to or shaped onto jet plate 2 and positioned opposite wall 6, there is fastened a piezo-electric bender unit 12 that is held in place by jointly operating placement means, for example by pins 10, which have been inserted into the drilled holes of support 9 and which engage with the drilled holes of unit 12.

Unit 12 consists of a piezo-ceramic plate 13, that has its upper surface covered with a thin metal foil 14 and its lower surface covered with a relatively thicker metal foil 15. From the free end 16 via the jets 7 up to the support 9, there have been cut, at regular intervals, into the connecting plate, slots 17,—for instance ground with a diamond disc—so that element 12 has a comb-like structure with a connection cross-piece 18 above support 9 and tine 19. The foil 14 on cross-piece 18 is interrupted in the extension of slots 17 so that for each tine 19 there is formed a foil strip. Foil 15, however, on cross-piece 18 is continuous and protrudes frontally from plate 13. It is connected with a connection line 20 for the return lead. Each strip of foil 14 is connected with one respective connection line 21 for the outgoing lead. As is apparent from FIGS. 3 and 4, there are attached to jet plate 2, separating walls 26, connected frontally to a chamber wall 6, 25, which separate two tines 19 each, and which are substantially narrower than slots 17.

FIGS. 2*a* to 2*d* illustrate schematically the operating mode of the described droplet generator. FIG. 2*a* shows a tine 19 in resting position. Negative pressure prevails in the fluid chamber 5 so that a concave meniscus 28 is formed in jet 7, the capillary pressure of which is in equilibrium with he negative pressure. If a voltage is placed on connection 21, than the piezo-ceramic layer 13 of tine 19 attempts to shorten itself under the influence of the electrical field (transversal effect). The thicker metal foil 15 offers greater resistance toward shortening than the thinner metal foil 14, so that tine 19 flexes away from the jet plate 2 (FIG. 2*b*). The deformation speed is selected in such manner, through the appropriate selection of pulse form at connection 21, that the fluid meniscus 28 in jet 7 will retract only very little. With drop of the pulse at connection 21 and outflow of the previously introduced electrical charge, tine 19 springs back to its basic position (FIG. 2*c*) and a drop 29 is expelled from jet 7. FIG. 2*d* illustrates the status shortly after droplet expulsion. The fluid meniscus 28 has retracted more deeply into jet 7. Additional fluid flows through the inlet aperture 8 until the meniscus 28 has again reached its state of equilibrium.

Since the tine movement takes place between two separation walls, pressure impulses cannot be propagated to adjacent jets 7, nor can adjacent tines be excited through viscous friction. Thus the risk of cross communication will be avoided. Since the fluid cannot elude laterally, significantly improved efficiency is achieved.

Bender under 12 preferably has an electrical insulating coating. Appropriate for this purposes are, for example:

- coating with liquid reaction resins through immersion or spray-on, with subsequent centrifuging of the excess volume and thermal or radiation hardening,
- coating with diluted reaction varnishes through immersion or spray-on, with subsequent drawing-off of air and hardening,
- coating with powdery thermoplastics through whirl-sintering, thereby warming of the piezo comb through high-frequency alternating voltage.

The following are used, for example, as coating materials: ORMOCERs (organically modified ceramics), Epoxides, acrylates, polyurethanes as well as thermoplastic polymers. The selection is based on the operating fluid employed, since resistance of the coating to action of the fluid is required. The fluid, however, must also adequately wet the coated surfaces, so that excellent drawing-off of air in chamber 5 of the droplet generator is possible.

As a result of the non-conducting coating electrically conducting inks can be employed, such as water-based inks, which are desired in many instances for print applications. With the droplet generators in accordance with the initially named state of the art, however, only electrically non-conducting inks could be used. Thus the application range of these devices was substantially restricted. Additionally, this non-conducting characteristic made the ink, under certain circumstances, significantly more expensive.

FIG. 6 represents a bi-morpheme flectional bender-element 12. It consists of the piezo-ceramic layer 13, the relatively thick metal foil 15 glued thereto, which simultaneously forms the electrode for the return conductor as well as electrode 34, which replaces the thinner metal foil 14, according to FIGS. 1–5. For the generation of high field forces, relatively high voltages are, in fact, required, as with the specific embodiment according to FIGS. 1–5. Because of the very thin electrode 34, the required voltages, however, are lower than with the specific embodiment according to FIGS. 1–5.

In FIG. 7 there is represented a so-called SS-CMB (single sided ceramic multilayer bender). These benders have been described in more detail by J. Verkerk, et al. in "Actuator 94 Conference Proceedings" Bremem 1994, to which reference is made. The element 12 consists here of an active piezo ceramic layer 35, a passive piezo ceramic layer 36 as well as several electrode layers 37, which subdivide the layer 35 into several layers and which alternatingly are connected with frontal metallizings 38, 39 and thereby with the connection lines 20, 21. The layers 40 of coating 35 are alternatingly oppositely polarized. Because the direction of the field likewise changes from layer to layer, when voltage is applied, layer 35, as a whole, vis-a-vis the passive layer 35, becomes shorter or longer, depending upon the polarity of the applied voltage. Through parallel connection of many thin piezo-ceramic layers (20–100 μm per layer) in the SS-CMB, already relatively low voltages are sufficient in order to reach high field forces. Thus the required impulse voltage for droplet expulsion, depending upon thickness and number of layers, drops to approximately 20–40 V. Another advantage consists in that temperature fluctuations produce only negligible deformations of the tines, since, except for the extremely thin electrode layers (1–2 μm per layer), only one single material is used.

FIG. 8 illustrates a symmetrical, multi-layer flectional bender-element. It is produced through laminating two layers 45, 46 of piezo-active material with the same polarity orientation. The exterior electrodes 47, which are connected with each other via the frontal metallizing 38, are connected jointly for all tines to the return conductor 21. The center electrode 48 is severed in the extension of slots 17, prior to lamination of the second piezo-active layer 45. When applying a voltage between the center and the exterior electrode, each layer will change its length, cross-wise vis-a-vis the electrical field, according to its direction, in other words, the one layer will become shorter, the other longer. Since the layers are firmly connected with each other, the layer construction becomes deformed. With this construction as well, the voltage needed for deflection can be significantly reduced, because the field force is doubled with equal tine thickness and equal voltage, and both layers 45, 46 are active in outward bending direction, while in the specific embodiment according to FIG. 6, foil 15 acts only passively.

For the printing system in use today with a print screen of 300 dots per inch, the jets 7 and thus also the tines 19 must be arranged very closely together. If the minimum size of the benders so permits, a one to two-row arrangement should be sought. With two-row construction (FIGS. 4 and 5) for 300 dpi, the spacing of the tines 19 in one row is 1/150" or approximately 170 μm. A 100 μm wide tine with a surrounding gap of 20 μm width requires configuration of 30 μm separation walls. So that the individual tines are able to transfer sufficient motion energy to the ink, they must have a multiple height of said width, for example they may have a height to width ratio (aspect ratio) of 5:1.

As a consequent of the above, the separation walls 26 must be designed with significantly greater aspect ratios. At the present time, suitable technologies are available to that end, for example the LIGA-Process or anisotropic etching of silicon monocrystals. These processes are described in W. Menz, P. Bley: Microsystems Technology for Engineers, Weinheim 1993. Other suitable processes for the manufacture of the separation walls are for example the galvanic precipitation of metals onto the jet plate 2, the pressing or injection moulding, whereby in these latter two instances, the moulds can be manufactured with the LIGA-Process. Specifically with manufacture through injection moulding, the separation walls 25 can be formed in a single piece with the jet plate 2, the frame 3, the pedestal 9 and, perhaps, the intermediary wall 25 (FIG. 4). Further suitable processes for the manufacture of the separation walls 26 are the photolithographic structuring of photoresist varnishes or photoresist foils. The Tape Automated Bonding Process is, for example suitable for connection of lines 21, 22.

The specific embodiments according to FIGS. 9–11 illustrate variations in which the housing 1 contains several chamber 5, arranged in graduated fashion, with each one bender element 12, according to FIGS. 1–3 or according to one of the FIGS. 6–8. The axes of jet 7 extend, at least at the outlet end, inclined or at right angle to the motion direction of the tine ends 16. The jets 7 are narrowed toward the outlet cross section. The jets 7 of the various rows are somewhat staggered vis-a-vis each other in the longitudinal direction of the rows.

In the specific embodiment according to FIG. 9, the three identical housing elements 55 are stacked on top of each other in accordance with FIG. 1, but with a thicker jet plate 56 and an additional jet plate 56. The jet channel 57 is bent at right angles. An additional channel 58 connects the inlet aperture 8 with a distribution channel 59 in a cover plate 60.

In the specific embodiment according to FIG. 10, the axes of the jets 7 extend at 45° to the motion direction of the tine ends 16.

In the specific embodiment according to FIG. 11, there are arranged four rows of jets 7 in one continuous jet plate 65 and the tine ends 16 are ground off at 45° so that their front surfaces 66 extend parallel to plate 65. With deflection of the tines 19, the frontal ends 66 thus have a motion component vertical to plate 65. The chambers 5 here have lateral connections, which can be connected via a distribution line with the storage container. The connections however can also be each connected to a separate container, whereby the containers may contain inks of different colors, so that the droplet generator is also suitable for multi-color print. This variation is also possible in the specific embodiments according to FIGS. 9 and 10, in that the distribution plate 60 is left off and channels 58 are connected to separate containers.

With the specific embodiments according to FIGS. 9–11, a great number of jets 7 can be arranged in extremely limited space, so that outstanding print quality is made possible.

The invention has been described with reference to the preferred and alternate embodiments. Obviously, modifications and alterations will occur to others upon a reading and understanding of this specification. It is intended to include all such modifications and alterations insofar as they come within the scope of the appended claims or the equivalents thereof.

Having thus described the invention, it is claimed:

1. Droplet generator for micro-drops, specifically for ink-jet printers, comprising:

a housing (1) defining a chamber (5);

a multitude of piezo-electric flectional benders (19) in the chamber (5) each having a first end (18) and a free second end (16) with each first end (18) fastened to housing (1) and with a separate jet (7) in a chamber wall (2) under each free second end (16) of benders (19), characterized in that the chamber (5) at least adjacent to the second end (16) of the benders (19) is subdivided through separation walls (26) located between said benders.

2. Droplet generator according to claim 1 wherein the first ends (18) of the benders (19) are connected with each other, so that the benders (19) form a comb-like bender unit (12).

3. Droplet generator according to claim 1 wherein the ratio of the height to the thickness of the separation walls (26) is between 10 and 100.

4. Droplet generator according to claim 1 wherein the separation walls (26) are manufactured by galvanic precipitation of metal or by anisotropic etching of monocrystalline silicone or by injection moulding or by pressing or by photographic structuring of photoresist varnishes or photoresist foils.

5. Droplet generator according to claim 1 wherein the free second ends (16) have frontal surfaces with the frontal surfaces of the free second ends (16) of the benders (19) having a distance from a chamber wall (6) which is a maximum of 5 times the space between benders (19) and separation walls (26).

6. Droplet generator according to claim 1 wherein the jets (7) are narrowed towards their exit cross section.

7. Droplet generator according to claim 1 wherein the surfaces of the benders (19) are covered with an electrically non-conducting coating, which preferably consists of ORMOCER material or of epoxy resin or of an acrylate polymer or of polyurethane.

8. Droplet generator according to claim 1 wherein the benders (19) and the housing (1) have cooperating positioning elements (10).

9. Droplet generator according to claim 1 wherein the benders (19) are designed as multi-layer piezo-ceramic benders, with an additional passive piezo-ceramic layer or as symmetrical multi-layer flectional benders.

10. Droplet generator according to claim 1 wherein the benders (19) in their basic position in the area of their second ends (16) are at a distance from the chamber wall (2).

11. Droplet generator according to claim 1 wherein housing (1) includes several chambers (5) arranged in staggered array with each chamber containing a row of benders (19), separation walls (26) and jets (7), and where the axes of the jets (7) at least at the outlet cross section, extend inclined or at right angles to the deflection direction of the second bender ends (16).

12. Droplet generator according to claim 1 wherein the free second ends (16) of the benders (19) are cut off at an angle inclined towards the longitudinal direction of the benders (19).

* * * * *